US005887403A

United States Patent [19]

Beck

[11] Patent Number: 5,887,403

[45] **Date of Patent: *Mar. 30, 1999**

[54] APPARATUS AND METHOD OF APPLYING BUILDING PANELS TO SURFACES

[75] Inventor: David H. Beck, Jackson, Mich.

[73] Assignee: CertainTeed Corporation, Valley Forge, Pa.

[ * ] Notice: The term of this patent shall not extend beyond the expiration date of Pat. No. 5,729,946.

[21] Appl. No.: 991,868

[22] Filed: Dec. 16, 1997

Related U.S. Application Data

[63] Continuation of Ser. No. 242,716, May 13, 1994, Pat. No. 5,729,946.

[51] Int. Cl.[6] ..... E04D 1/34; E04C 2/20

[52] U.S. Cl. ..... 52/518; 52/520; 52/521; 52/523; 52/524; 52/539; 52/543; 52/547; 52/747.1

[58] Field of Search ..... 52/518, 520, 543, 52/523, 547, 747.1, 521, 524, 539

[56] References Cited

U.S. PATENT DOCUMENTS

| | | | |
|---|---|---|---|
| 2,961,804 | 11/1960 | Beckman . | |
| 3,343,325 | 9/1967 | Curran . | |
| 3,738,076 | 6/1973 | Kessler . | |
| 3,757,483 | 9/1973 | Torbett . | |
| 4,292,781 | 10/1981 | Chalmers et al. . | |
| 4,424,655 | 1/1984 | Trostle . | |
| 4,782,638 | 11/1988 | Hovind . | |
| 4,843,790 | 7/1989 | Taravella | 52/518 X |
| 4,947,609 | 8/1990 | Champagne . | |
| 5,016,416 | 5/1991 | Munk . | |
| 5,363,623 | 11/1994 | King | 52/520 |
| 5,392,579 | 2/1995 | Champagne . | |
| 5,548,940 | 8/1996 | Baldock | 52/518 X |
| 5,575,127 | 11/1996 | O'Neal | 52/520 |
| 5,577,360 | 11/1996 | Gibbs | 52/518 |
| 5,634,314 | 6/1997 | Champagne | 52/520 X |
| 5,657,585 | 8/1997 | Zaccagni | 52/518 X |
| 5,729,946 | 3/1998 | Beck | 52/520 |

FOREIGN PATENT DOCUMENTS

| | | |
|---|---|---|
| 612570 | 11/1948 | United Kingdom . |

*Primary Examiner*—Christopher Kent
*Attorney, Agent, or Firm*—Paul & Paul

[57] ABSTRACT

An apparatus and method is provided for applying building panels, such as siding panels, to building surfaces, such as walls. The panels are of a type which undergo expansion and contraction due to changes in temperature, and they are applied to a building surface, such as a wall, by means of nails, screws, staples or the like. In order to accommodate the expansion and contraction of the panels, the panels are provided with an attachment hem, such as a strip of relatively flexible material, generally rubber-like or fabric-like in nature. A strip of relatively flexible material may be secured to the relatively rigid building panel by any suitable means, such as adhesive securement, welding, heat fusing, etc., such that it becomes an integral part of the building panel, or the relatively flexible attachment hem may comprise a separate component which, when applied to a building surface, such as a wall or the like, by a suitable nailing, stapling, etc., serves to lock in place the relatively rigid building panel by means of engaging a lip or like portion of the same.

2 Claims, 2 Drawing Sheets

APPARATUS AND METHOD OF APPLYING BUILDING PANELS TO SURFACES

CROSS-REFERENCE TO RELATED APPLICATION

This is a continuation of application Ser. No. 08/242,716, filed May 13, 1994, now U.S. Pat. No. 5,729,946.

BACKGROUND OF THE INVENTION

In the art of building construction, it is known to apply relatively rigid building panels, such as siding panels or the like, to a wall of a building. Frequently such panels are constructed of vinyl siding, hardboard, aluminum or the like. In many such instances, the siding, particularly in the case of vinyl siding and aluminum siding, is configured to simulate wood siding construction, and such siding may be extruded, bent, molded or otherwise configured to have lap zones or the like, whereby one edge, such as an upper edge of the panel will be provided with a nailing hem, which hem is in the covered condition after installation by means of the next-applied panel engaging a lap joint of the first-applied panel, and covering the nailing hem of the first-applied panel.

In connection with such prior art application of building panels, it is commonplace that the nailing hem be provided with a slotted hole to accommodate expansion and contraction of the panel due to variations in temperature. Such slotted holes or nailing slots allow the panels to be secured to a wall or other building surface by placing the nail generally in the center of the slot, and hammering it into the building surface, such that, after installation, a given panel is carried by a plurality of nails in similar nailing slots, whereby the panel may free-float on the nails, because the nails are not hammered tightly "home," into the building surface. However, it is not always practical to nail the nails into the center of a nailing slot, and if many nails are nailed toward the end of the nailing slot, the purpose of having a free-floating panel is not achieved, and the desired expansion and contraction in the panel due to changes in temperature will not be accommodated to the extent desirable. Additionally, constantly nailing such relatively "loose" or floating panels provides assembly difficulty. Furthermore, in nailing siding or other panels to building walls, it Is inefficient to constantly be concerned about proper placement of the nail in the center of a slotted hole. Other means of assembly, such as power nailing, stapling and the like would be more efficient, if one did not have to be concerned with correct placement of the nail, staple or other fastener relative to the slotted hole.

THE PRESENT INVENTION

The present invention is directed to allowing the fastening of relatively rigid panels, such as siding materials, to the wall of a building without adversely affecting the siding performance. Specifically, the invention allows the normal expansion and contraction of the panels, and allows assembly of panels onto uneven wall surfaces, while still allowing for rigid fastening of the panels to the surfaces.

Most specifically, the present invention employs a relatively flexible attachment member which may be quickly installed onto a wall by means of power nailers, staplers, or other fasteners, which allows for ease of installation without requiring concern over centering the fastener into a nail slot.

The relatively flexible attachment member, in the form of a nail hem or the like, is made of a preferably rubberlike or fabric-like material that stretches or compresses. In its preferred form, the relatively flexible attachment hem or other member may be made to be integral with the relatively rigid panel member, by being adhesively secured thereto, bonded, fused or welded thereto, or even stapled or mechanically interlocked thereto, etc. or a combination of any of such securement techniques, although the relatively flexible attachment member may, in the alternative, comprise a separate member that partially overlies, or otherwise holds the relatively rigid panel member to a wall. The relatively flexible panel member may, for example, be constructed of polyvinyl chloride, rubber, various polymers, or even fabric, or a combination or mix of any of them, and will have the desired flexibility. Suitable fasteners, such as power nailers, staplers, screws or even adhesives or a combination of any of them may be used to secure the relatively flexible attachment members to a building surface. In the case of steel stud use, in particular, screws may be particularly desirable although other fasteners may be used in addition or instead. In the case of adhesive securement of the relatively flexible attachment member to a building surface, whether or not the attachment member is made integral with or secured to the relatively rigid covering panel prior to installation, the adhesive by which the relatively flexible attachment member is secured to a building wall may, for example, be covered by a release strip of paper, which once removed, allows simply pressing the relatively flexible attachment member into fastening engagement on a building wall.

Accordingly, it is a primary object of this invention to provide an efficient method and apparatus for applying relatively rigid building panels onto building walls, to allow for expansion and contraction of panels without requiring the use of slotted nailing holes.

It is another object of this invention to accomplish the above object, by the use of a relatively flexible attachment member which may be attached to a building wall by relatively rigid fasteners, and which in turn, can either be attached to and carried by a relatively rigid building material panel, or may hold a relatively rigid building material panel to a wall when the relatively flexible attachment member is applied to a building wall.

Other objects and advantages of the present invention will be readily understood by a reading of the brief descriptions of the drawing figures, detailed descriptions of the preferred embodiments, and the appended claims.

BRIEF DESCRIPTIONS OF THE DRAWING FIGURES

FIG. 6 is another illustration of applying a relatively rigid siding material to a building wall, in which case the siding material comprises hardboard panels having the relatively flexible attachment members secured thereto, which attachment members are in turn fastened to a building wall by means of staples or the like.

DETAILED DESCRIPTIONS OF THE PREFERRED EMBODIMENTS

Figure 1:
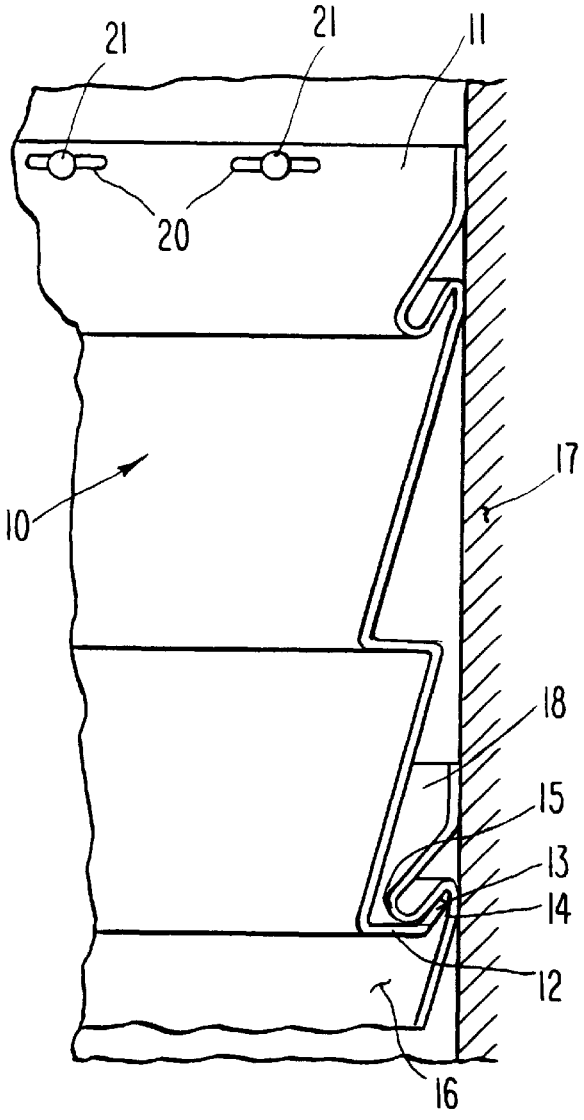
PRIOR ART Fig. 1
FIG. 1 is a fragmentary perspective view of a prior art siding installation applied to a building wall, whereby nails are placed at the approximate centers of slotted holes and are nailed through the slotted holes into engagement with a building wall, with the slotted holes being located in a nailing hem of the siding panel.

Referring now to the drawings in detail, reference is first made to the prior art illustration of FIG. 1, wherein a relatively rigid siding panel 10 is shown as having upper and lower opposite edge zones 11, 12, respectively, with the lower edge zone 12 having an upwardly extending lip 13, which engages la a groove 14 of a downwardly turned lap joint 15 at the upper edge zone of a next-previously applied siding panel 16, whereby the lower end 12 of the relatively rigid panel 10 is secured against a building wall 17, in that the upper edge zone 18 of the lower panel 16 is fastened to the building wall 17 by suitable nails or the like (not shown).

The upper edge zone 11 of the panel 10 comprises a nailing zone, whereby a plurality of slots 20 are provided, whereby nails 21 may be placed approximately in the center of the slots, and hammered in to the building wall 17, an amount sufficient to hold the panel 10 against the wall, but preferably not hammered "tightly home," to allow the normal expansion and contraction movement of the siding 10 leftward and rightward to accommodate the expansion and contraction caused by variations in temperature, whereby the horizontal slots 20 allow the panel to slide along the nails 21.

Figure 2:
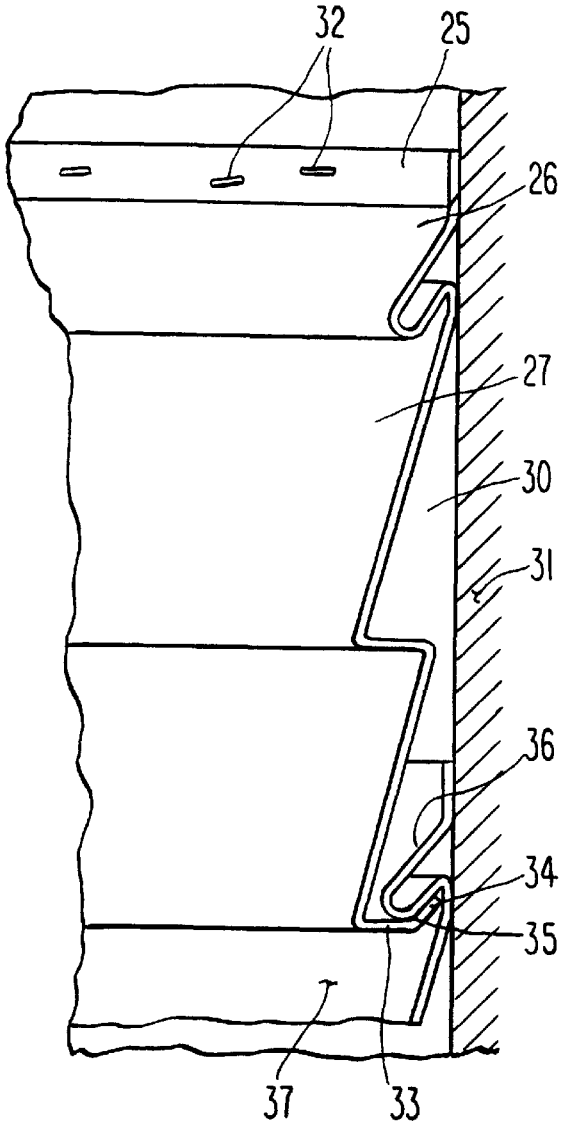
FIG. 2 is an illustration like that of FIG. 1, but wherein the relatively rigid siding panel is provided with a relatively flexible attachment member, fused or otherwise secured thereto, which attachment is then shown as being applied to the building wall by means of relatively rigid fasteners, such as staples.
Figure 3:
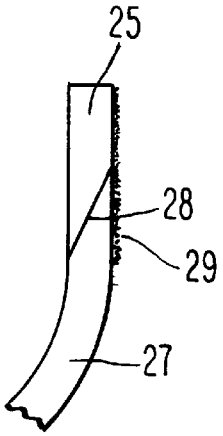
FIG. 3 is a fragmentary enlarged side elevational view of an upper edge of siding, whereby the nailing hem is shown as comprising a relatively flexible siding member secured to the relatively rigid panel member, along a line of fusion, where the relatively flexible material is fused to the relatively rigid material.

With reference now to FIG. 2, there is illustrated a preferred embodiment of the present invention, in which a relatively flexible nailing hem 25 is provided at the upper edge zone 26 of a relatively rigid siding panel 27, fused thereto, as is shown more clearly in FIG. 3, along a fusion line 28, by means of heat fusion, adhesive securement, sonic welding, mechanical interlock or the like. It will also be noted that where the siding panel 27 is an extruded panel, such as a vinyl panel, the relatively flexible attachment hem 25 may be co-extruded as the relatively rigid vinyl panel 27 is extruded. In any event, the relatively flexible attachment member 2, as shown in FIGS. 2 and 3 becomes integral with the relatively rigid panel 27, such that it may be stapled to a surface 30 of a building wall 31, by means of suitable staples such as those 32 delivered from a staple gun, power stapler, or the like, or adhesively applied to a wall 31 by an adhesive 29 on a surface thereof.

It will be noted that, as in the prior art illustration of FIG. 1, the lower edge zone 33 of the panel 27 will have an upwardly extending lip 34, secured in a downwardly opening grove 35 of a lap joint 36 of a next-previously applied panel 37, such that the panel 27 is held against the wall 31 at its lower end, and is fastened to the wall 31 at its upper end by means of the staples 32, as shown.

Figure 4:
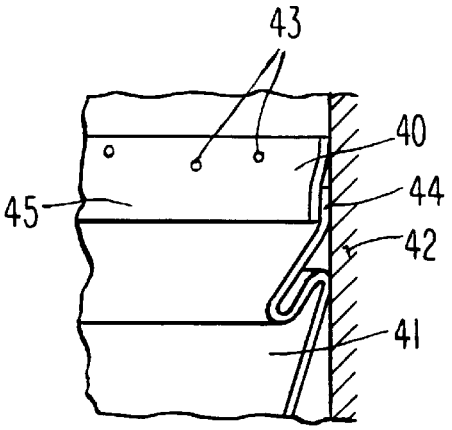
FIG. 4 is a fragmentary illustration of another embodiment of this invention, in which the relatively flexible attachment member is separate from the siding panel, and which secures the siding panel to a building wall.

With reference to FIG. 4, it will be seen that the relatively flexible attachment member 40 is separate from the relatively rigid panel 41, and is applied to the building wall 42 by means of suitable nail-like fasteners 43 or the like. The upper lip 44 of the relatively rigid panel 41 is overlapped by the lower end 45 of the flexible panel 44, which holds the lip 44 against the wall 42.

Figure 5:
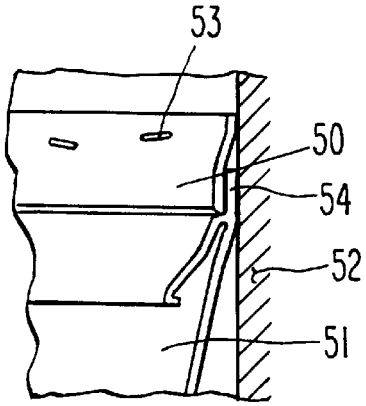
FIG. 5 is an illustration like that of FIG. 4, but wherein the relative rigid siding material is of a different extruded design than that of FIG. 4, and wherein the nailing hem is likewise a separate attachment member holding the relatively rigid siding in place against a building wall.

In FIG. 5, an alternative design for a relatively rigid panel 51 is provided, such that an upstanding lip 54 thereof is engaged by the separate relatively flexible attachment member 50, holding the lip 54 against the building wall 52, and the relatively flexible attachment member 50, is, in turn, fastened to the building wall 52 via suitable staples 53 or the like.

Figure 6:
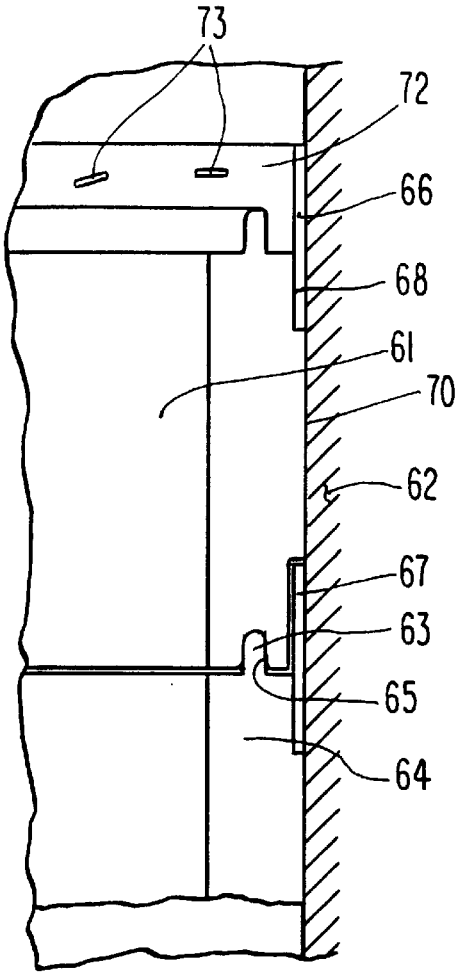

With reference now to FIG. 6, there is shown an alternative type of relatively rigid covering panels 61, in the form of hardboard panels 61 applied to a building wall 62.

The panels 61 are of the type having tongue-and-groove interconnections at upper and lower edges thereof, such as with the tongue 63 of a lower panel 64 in engagement in a grove 65 of the upper panel 61. The panels 64, 61, comprise the relatively rigid panels in this embodiment, and they, in turn, are provided with relatively flexible attachment members 66, 67, secured in some appropriate manner, such as by glue or other adhesives, into notches such as that 68 at the upper end, and in the rear surface 70 of the relatively rigid panels, such as that 61. The nailing hem 72 of the relatively flexible attachment member 66 is suitably fastened to the wall 62 by means of suitable nails, staples or the like 73.

As discussed above, the relatively flexible attachment members may be fastened to a building wall by means of adhesives or the like, such as, by employing an adhesive on the surface that is to be applied to the wall, perhaps by a strip of removable release paper or the like, which, once removed, leaves a tacky surface ready for application to a building wall by simply placing the same thereagainst. It will further be understood that various other types of fasteners, other than adhesives, nails, staples or the like, may be used as fasteners for fastening the relatively flexible attachment members to a building wall. It will further be understood that the relatively flexible attachment members may be separate members as in the case of embodiments of FIGS. 4 and 5, or may be made integral therewith, as in the case of the embodiment of FIGS. 2–3 and 6. Where the flexible members are made integral with the rigid panel members, such may be done by various techniques, such as gluing, melting together, sonic welding, heat fusion, co-extrusion, etc., or by any other means, even mechanical fastening means, such as stapling the relatively flexible member to the relatively rigid member (not shown). It will further be understood that the materials of construction of the relatively flexible members may be varied, to include rubber-like materials, fabrics, relatively flexible sheet materials, or the like, and that such may be co-extensive in horizontal length with the relatively rigid panels, as shown herein, or may be comprised of relatively short strips, nailing hems, or tabs (not shown), or the like. Additionally, the relatively rigid panels may take on various forms other than those specifically disclosed herein, and may comprise siding panels, roofing panels or the like, comprised of vinyl, aluminum, other sheet metals or thermoplastics, or even wood or the like, as desired. Thus, it will be apparent from the foregoing that various modifications may be made in the details of constructions, as well as in the use and operation of the exterior covering, assembly and components thereof of the present invention, all within the spirit and scope of the invention as defined in the appended claims.

I claim:

1. An exterior covering assembly for covering building surfaces, comprising:

(a) a plurality of relatively rigid covering panels for covering at least a portion of a building surface;

(b) a plurality of relatively flexible attachment members for attaching relatively rigid panels to the building surface while in engagement with said panels; and (c) a plurality of fastener means for fastening relatively flexible attachment members to the building surface; wherein (d) said relatively flexible attachment members comprise means operationally connecting said relatively rigid covering panels and said fastener means, for indirectly attaching said panels to a building surface via said relatively flexible attachment members, (e) whereby expansion and contraction of said relatively rigid covering panels with variations in temperature is accommodated by the flexibility of said relatively flexible attachment members;

(f) wherein said relatively rigid covering panels are co-extruded with the relatively flexible attachment members connected thereto.

2. A method of covering a building surface comprising the steps of:

(a) providing a plurality of relatively rigid covering panels for covering at least a portion of a building surface;

(b) providing a plurality of relatively flexible attachment members for attaching relatively rigid panels to a building surface while in engagement with said panels;

(c) providing a plurality of fastener means for fastening relatively flexible attachment members to a building surface; and (d) operationally connecting said relatively rigid covering panels and said fastener means, for indirectly attaching said panels to a building surface via said relatively flexible attachment members;

(e) whereby expansion and contraction of said relatively rigid covering panels with variations in temperature is accommodated by the flexibility of said relatively flexibility attachment members, without interfering with the security of attachment of said fastener members to the building surface;

(f) including the step of co-extruding the relatively flexible attachment members with the relatively rigid covering panels.

* * * * *